US008646400B2

(12) United States Patent
Grimaldi

(10) Patent No.: US 8,646,400 B2
(45) Date of Patent: Feb. 11, 2014

(54) MOVABLE PLATFORM ASSEMBLY FOR A BOAT, PARTICULARLY FOR HAULING OR LAUNCHING TENDERS OR THE LIKE

(75) Inventor: Michele Grimaldi, Piossasco (IT)

(73) Assignee: Opacmare S.p.A, Rivalta (Torin) (IT)

( * ) Notice: Subject to any disclaimer, the term of this patent is extended or adjusted under 35 U.S.C. 154(b) by 658 days.

(21) Appl. No.: 12/746,696

(22) PCT Filed: Feb. 20, 2008

(86) PCT No.: PCT/IT2008/000110
§ 371 (c)(1),
(2), (4) Date: Jun. 7, 2010

(87) PCT Pub. No.: WO2009/084065
PCT Pub. Date: Jul. 9, 2009

(65) Prior Publication Data

US 2010/0288179 A1 Nov. 18, 2010

(30) Foreign Application Priority Data

Dec. 28, 2007 (WO) ..... PCT/IT2007/000920

(51) Int. Cl.
*B63B 17/00* (2006.01)

(52) U.S. Cl.
USPC ..... 114/362

(58) Field of Classification Search
CPC ..... B63B 27/36; B63B 27/146
USPC ..... 414/137.1, 545–546, 556–559, 640, 414/678–679, 701, 917, 921; 114/362, 72, 114/258, 259, 261, 268, 363; 701/50
See application file for complete search history.

(56) References Cited

U.S. PATENT DOCUMENTS 1,215,827 A * 2/1917 Lord ..... 182/1
2,936,086 A * 5/1960 Pueschner et al. ..... 414/702

(Continued)

FOREIGN PATENT DOCUMENTS

DE 33 01 179 A1 7/1984
DE 199 63 057 C1 12/2000

(Continued)

OTHER PUBLICATIONS

Sclater, N., Mechanisms and Mechanical Devices Sourcebook, 4th Edition (2007), McGraw-Hill, p. 25.*

*Primary Examiner* — Saul Rodriguez
*Assistant Examiner* — Brendan Tighe
(74) *Attorney, Agent, or Firm* — Sughrue Mion, PLLC

(57) ABSTRACT

A movable platform assembly comprises a base portion, able to be fixed to a support structure, and at least one pivotable arm hinged at one end with the base portion, about a first hinging axis, and at the other end with a loading platform, about a second hinging axis, the pivotable arm being able to be rotated by means of actuating devices, which are designed to allow the platform to maintain a constant inclination with respect to the base portion during rotation of the pivotable arm. The actuating devices comprise a first and a second rotary actuator mounted on the first and second hinging axis, respectively. The first rotary actuator comprises a first part fastened to the base portion and a second part rotatable with respect to the first part and fastened to the pivotable arm, and the second rotary actuator comprising a first part fastened to the loading platform and a second part rotatable with respect to the first part and fastened to the pivotable arm, said actuating devices also comprising control devices able to control in a co-ordinated manner rotation of said first and second rotary actuators.

6 Claims, 4 Drawing Sheets

(56) References Cited

U.S. PATENT DOCUMENTS

Figure 5:
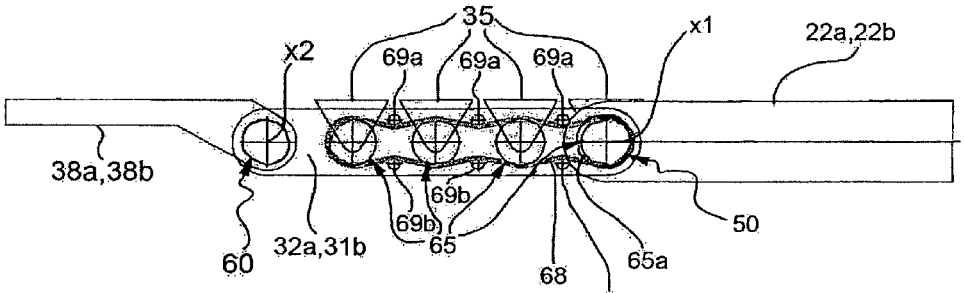

| | | | | |
|---|---|---|---|---|
| 4,293,967 | A | 10/1981 | Ord | |
| 4,971,168 | A | 11/1990 | Stanescu | |
| 5,794,292 | A | 8/1998 | Ricci, Jr. | |
| 5,835,874 | A * | 11/1998 | Hirata et al. | 701/50 |
| 5,864,101 | A * | 1/1999 | Nishizawa et al. | 187/285 |
| 6,755,604 | B1 * | 6/2004 | Schaeff | 414/700 |
| 6,846,152 | B2 * | 1/2005 | Mikrut et al. | 414/700 |
| 7,121,226 | B2 * | 10/2006 | Grimaldi | 114/362 |
| 7,509,187 | B2 * | 3/2009 | Hayes et al. | 700/213 |

FOREIGN PATENT DOCUMENTS

| | | | |
|---|---|---|---|
| DE | 201 17 693 | U1 | 3/2002 |
| EP | 1 382 523 | A1 | 1/2004 |
| WO | 03/106254 | A1 | 12/2003 |

* cited by examiner

FIG.1
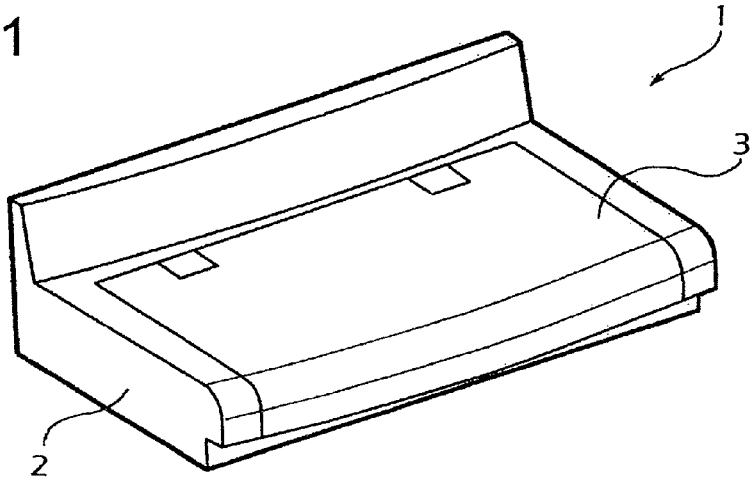
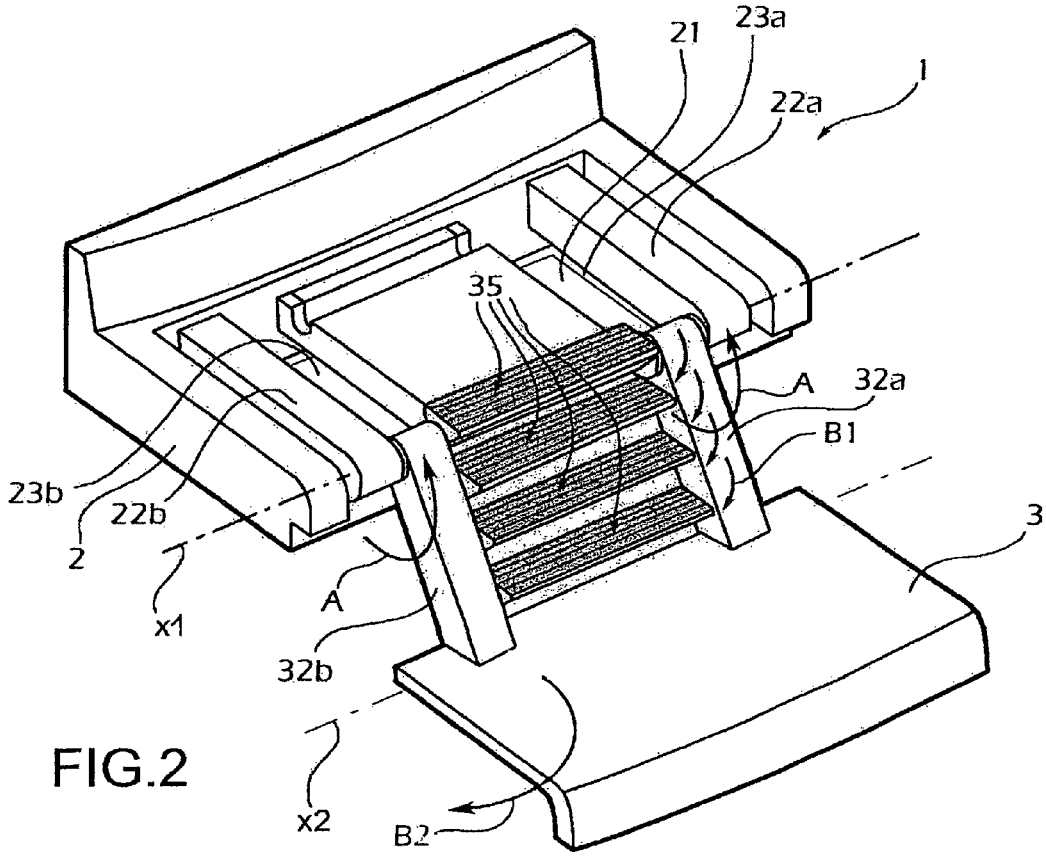
FIG.2

FIG.4
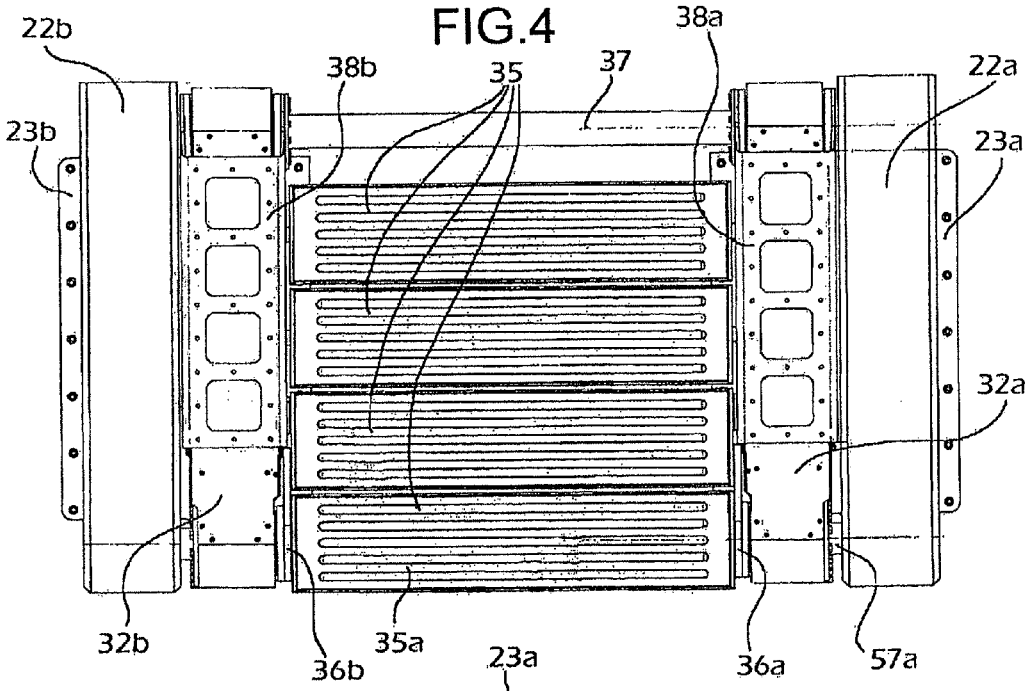
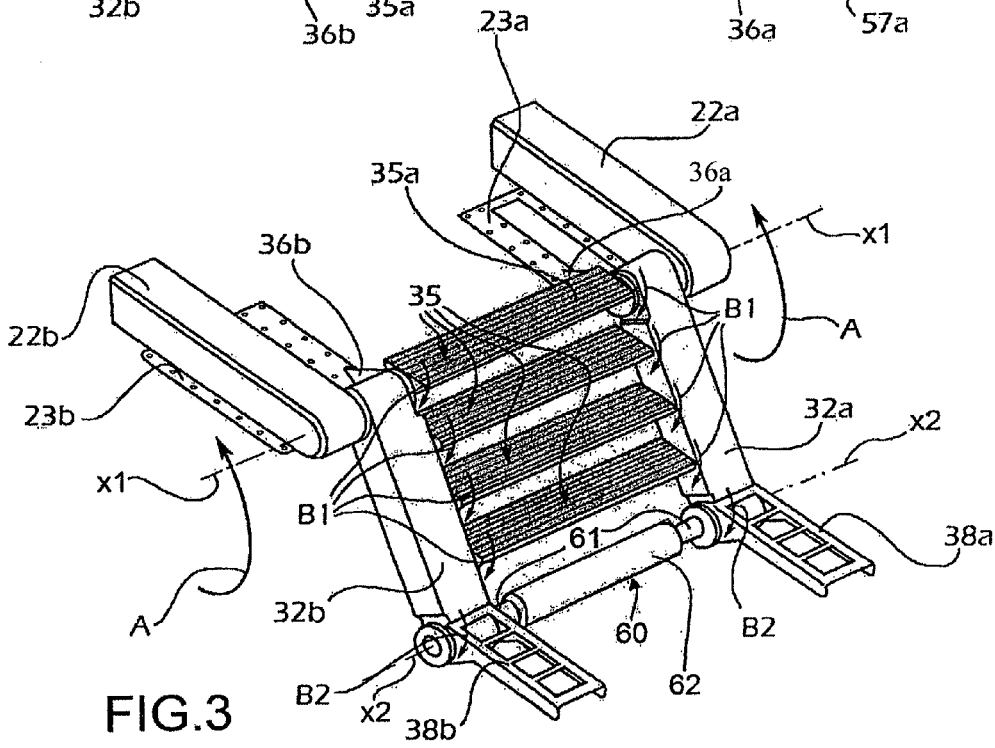
FIG.3

MOVABLE PLATFORM ASSEMBLY FOR A BOAT, PARTICULARLY FOR HAULING OR LAUNCHING TENDERS OR THE LIKE

CROSS REFERENCE TO RELATED APPLICATIONS

This application is a National Stage of International Application No. PCT/IT2008/000110 filed Feb. 20, 2008, claiming priority based on International Application No. PCT/IT2007/000920 filed Dec. 27, 2007, the contents of all of which are incorporated herein by reference in their entirety.

The present invention relates to a movable platform assembly, of the type comprising a base portion able to be fixed to a support structure and at least one pivotable arm hinged at one end with said base portion, about a first hinging axis, and at the other end, with a loading platform, about a second hinging axis, said at least one pivotable arm being able to be rotated via actuating means which are designed to allow said platform to maintain a constant inclination with respect to said base portion during rotation of said at least one pivotable arm.

A platform assembly of this type, which is specifically applied to a boat, is known from the international application WO 03/106254 A1 in the name of the same Applicant.

In this platform assembly, the movement of the pivotable arm(s) is obtained by means of chain-type transmission means, there being also envisaged additional chain-type transmission means which ensure the parallel alignment of the loading platform and the base portion.

Although this solution has proved to be particularly effective, the Applicant has investigated new solutions for moving the loading platform which are optimum also from the point of view of the compactness of the entire actuating system.

The invention therefore relates to a movable platform assembly of the type defined in the introduction, in which said actuating means comprise a first and a second rotary actuator mounted on said first and second hinging axes, respectively, in which the first rotary actuator comprises a first part fastened to the base portion and a second part rotatable with respect to the first part and fastened to the pivotable arm, and in which the second rotary actuator comprises a first part fastened to the loading platform and a second part rotatable with respect to the first part and fastened to the pivotable arm, said actuating means also comprising control means able to control in a co-ordinated manner rotation of said first and second rotary actuators.

Preferred embodiments are described in the dependent claims.

Figure 6:
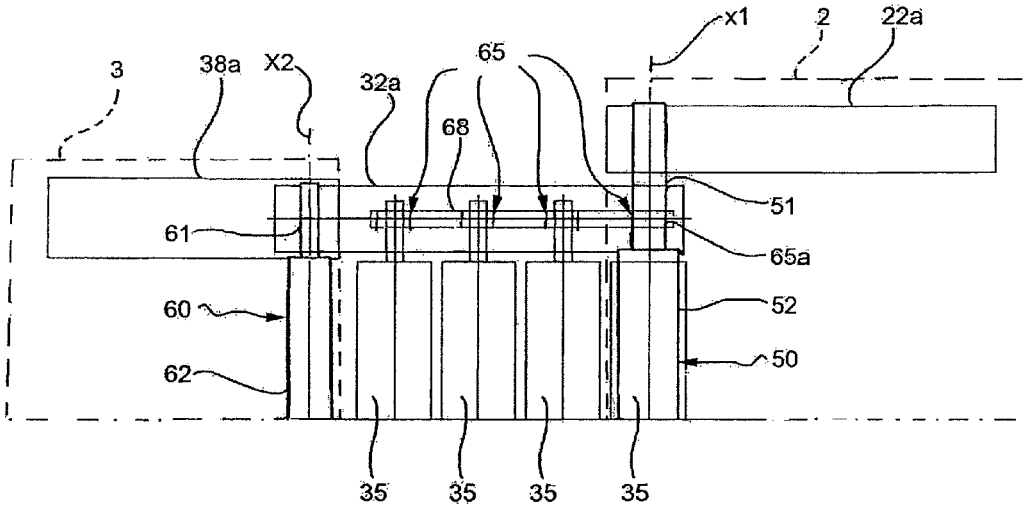
Figure 7:
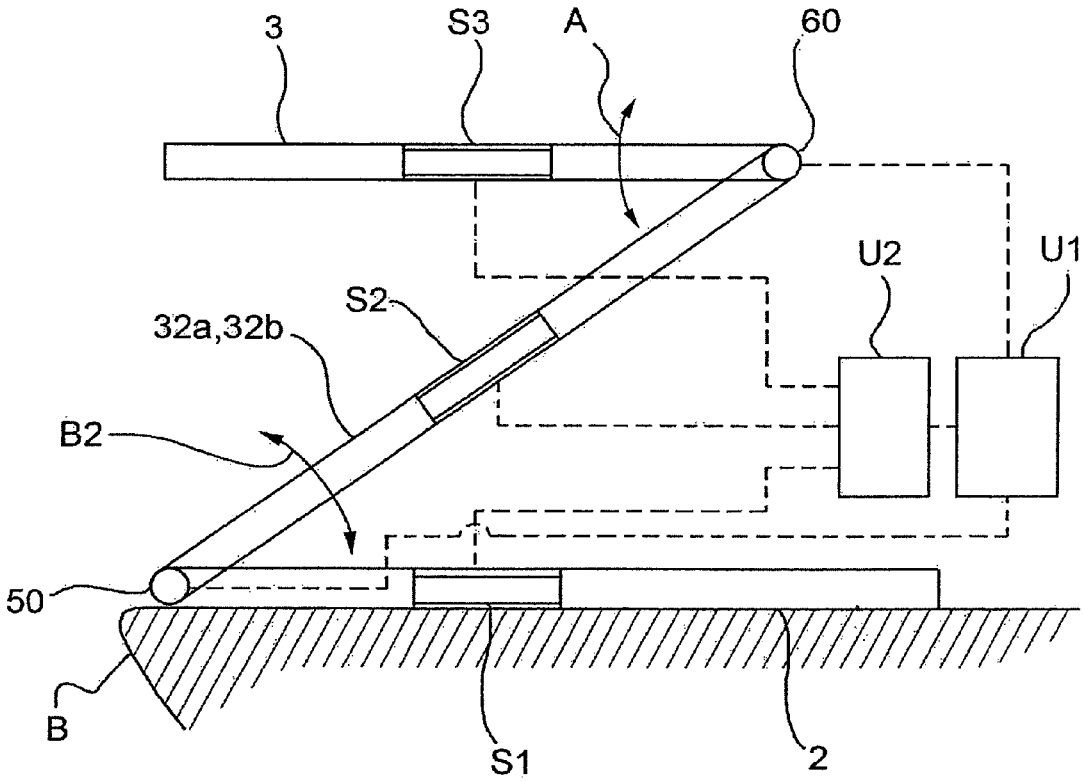

Further objects and advantages of the invention will become clearer from the following detailed description of a preferred, but non-limiting embodiment of the invention, provided with reference to the accompanying drawings in which:

- FIG. 1 is a perspective view of a platform assembly according to the present invention, shown in a first operative position;
- FIG. 2 is a perspective view of the platform assembly according to FIG. 1 in a second operative position;
- FIG. 3 is a perspective view of a structure of the platform assembly of FIG. 1 in the second operative position;
- FIG. 4 is a top plan view of the structure according to FIG. 3 in the first operative position;
- FIGS. 5 and 6 are a schematic side elevation view and schematic plan view, respectively, of the platform assembly according to the present invention; and
- FIG. 7 is a schematic view of the platform assembly for illustrating operation thereof according to the present invention.

With reference to FIG. 1 this shows a platform assembly 1 according to the invention, intended to be mounted on a support structure, for example, but not exclusively, on the stern portion of a boat. The platform assembly 1 comprises a base 2 with which a movable platform 3, shown in FIG. 1 in a closed position, is hinged. The base 2 may be provided with means (not shown) for allowing fixing of the assembly 1 to the support structure, or, in an alternative embodiment, may be incorporated in the support structure itself.

With reference to FIG. 2, the platform assembly 1 is shown in the fully open position. The base 2 of this assembly has a recess 21 intended to receive the movable platform 3. The recess 21 is formed so that the platform 3 in the closed position fits completely inside the overall form of the base 2, as shown in FIG. 1, resulting in the upper surface of the loading platform 3 being flush with the upper surface of the base 2. The recess 21 also houses a pair of fixed arms 22*a*, 22*b*.

As can be seen more clearly from FIG. 3, the fixed arms 22*a*, 22*b* are provided with respective fixing plates 23*a*, 23*b* which allow mounting thereof on the base 2 by means of conventional connection means, such as bolts for example. Respective swing arms 32*a*, 32*b* are hinged on the distal ends of the fixed arms 22*a*, 22*b* and are able to perform a rotation in a plane which is vertical (indicated by the arrow A in the figures), i.e. perpendicular to the general plane of the base 2 of the platform assembly 1. The axis for hinging of the swing arms 32*a*, 32*b* with respect to the fixed arms 22*a*, 22*b* is indicated by x1 in the figures. The swing arms 32*a*, 32*b* form with a plurality of surfaces 35 connected to them a ladder which can be oriented in a vertical plane. Each surface or step 35 is able to perform a relative rotation with respect to the swing arms 32*a*, 32*b* about its longitudinal axis (indicated by the arrows B1 in the figures). The step 35*a* closest to the base 2 of the platform assembly 1 is fastened to this base by means of a pair of brackets 36*a*, 36*b* which are fixed on one side to the ends of the step 35*a* and on the other side to the base 2 itself.

A pair of support feet 38*a*, 38*b* are hinged with the distal ends of the swing arms 32*a*, 32*b*. Their hinging axis is indicated by x2 in the figures. The support feet 38*a*, 38*b* are able to perform a relative rotation (namely that indicated by the arrows B2) with respect to the swing arms 32*a*, 32*b* in the vertical plane until they assume an arrangement folded back along these arms 32*a*, 32*b* in the closed position shown in FIG. 4. The support feet 38*a*, 38*b* allow mounting of the movable platform 3, as shown in FIG. 2.

The diagram shown in FIGS. 5 and 6 illustrates more clearly operation of the platform assembly according to the invention. This diagram shows the platform assembly 1. A first rotary actuator 50 is mounted coaxially with the axis x1 of hinging between of the fixed arms 22*a* and 22*b* and the swing arms 32*a*, 32*b*, while a second rotary actuator 60 is mounted coaxially with the axis x2 of hinging between the swing arms 32*a*, 32*b* and the support feet 38*a*, 38*b*. In the example shown the rotary actuators 50, 60 are formed as dual actuators (only half of which can be seen in FIG. 6) since they are envisaged for the movement of the two swing arms 32*a*, 32*b* and the two support feet 38*a*, 38*b*. These actuators are, for example, hydraulic actuators of the compact type, in particular of the type comprising a piston, the axial movement of which is converted into a rotary movement of a shaft.

The first dual rotary actuator 50 comprises a first part 51 fastened to the fixed arms 22*a*, 22*b*, and hence to the base 2, and a second part 52 which is rotatable with respect to the first part and fastened to the pivotable arms 32*a*, 32*b*. The first part 51 of the first rotary actuator 50 may consist of the two end shafts of the dual rotary actuator which are fixed respectively to the two fixed arms 22*a*, 22*b*. The second rotary actuator 60 comprises a first part 61 fastened to the support feet 38*a*, 38*b*, and hence to the loading platform 3, and a second part 62 which is rotatable with respect to the first part and fastened to the pivotable arms 32*a*, 32*b*. The first part 61 of the second rotary actuator 60 may consist of the two end shafts of the dual rotary actuator which are fixed to the two support feet 38*a*, 38*b* of the platform 3, respectively.

The movement of the two dual actuators 50 and 60 is performed by means of a hydraulic control unit, denoted by U1 in FIG. 7, which supplies liquid, for example oil, to these actuators.

With reference to FIG. 7, the actuating system also comprises an electronic control unit U2 which uses signals provided by sensors S1, S2, S3 to perform in a co-ordinated manner rotation of the first and second rotary actuators 50, 60. In particular, these sensors are absolute inclination sensors and comprise a reference sensor S1 fixed to the base 2 of the platform assembly and therefore to the support structure B, a movement sensor S3 fixed to the swing arm(s) 32*a* and 32*b* and an alignment sensor S3, fixed to the platform 3. The reference sensor S1 is able to provide the control unit U2 with a reference inclination signal indicating the inclination of the base 2 of the platform assembly. The movement sensor S2 is able to provide the control unit U2 with a movement inclination signal indicating the inclination of the swing arm(s) 32*a*, 32*b*. The reference sensor S3 is able to provide the control unit U2 with an alignment inclination signal indicating the inclination of the platform 3 of the platform assembly.

The control unit U2 is programmed to compare with each other the values of the reference signal and the alignment signal. If, during movement of the assembly, this control unit detects that these values differ by more than a certain tolerance, it intervenes, causing the hydraulic control unit U1 to vary distribution of the control liquid supplied to the two dual actuators 50, 60. In this way, during the whole of the movement of the swing arms 32*a*, 32*b*, it is ensured that the loading platform 3 maintains a constant orientation with respect to the base 2. Preferably, the control unit U1 is also programmed to compare with each other the values of the reference signal and the movement signal, so as to be able to determine the angle of rotation of the swing arms with respect to the base 2. This feature may have several regulating and/or safety functions. For example, by equipping the control unit with an interface with allows a user to set the desired angle of rotation with respect to the closed position, it is possible to program the control unit so that it stops the supply of liquid to the actuators when this desired angle is reached. It is also possible to program the control unit to activate an alarm signal or, in case of a movable support structure such as a boat, to prevent starting of the movable structure if it detects that the angle of movement is changing while someone is attempting to start the movable structure.

With the platform assembly according to the invention it is possible to obtain a rotation of the swing arms 32*a*, 32*b* with a maximum angle of about 240° and more, from the closed position, where these arms 32*a*, 32*b* are completely extended on the base 2 of the platform assembly 1, into the maximum open position allowed by the particular arrangement of the hinging axis x1 of the swing arms 32*a*, 32*b*.

Inside the pivotable arms 32*a*, 32*b*, which are constructed with a box-like form, there is provided an alignment unit which is able to keep the orientation of the steps 35 unvaried with respect to the base 2 during rotation of the pivotable arms. For this purpose, each step 35 (as shown in FIG. 5) is fastened to a respective pair of end pulleys 65. The pulleys 65 and the associated steps 35 are pivotably mounted on the pivotable arms 32*a*, 32*b* so as to have an axis of rotation which is parallel to the axis x. The step 35*a* closest to the base 2 is fastened to the respective pulleys 65*a* which are keyed onto the first part 51 of the first dual rotary actuator 50 fastened to the fixed arms 22*a*, 22*b*. In this way the step 35*a* remains immobile when the pivotable arms 32*a*, 32*b* rotate. An alignment chain 68 is wound around the pulleys 65 and 65*a* so as to allow rotation of all the pulleys in the same sense. Upper and lower tensioning devices 69*a*, 69*b* are also envisaged, these devices allowing the winding angle of the chain 68 on the pulleys 65, 65*a* to be increased and its tension to be kept constant.

The system for achieving alignment of the steps 35, however, must not be regarded as being limited to the example described hitherto, it being possible to envisage for this purpose other means which may occur to a person skilled in the art, for example lever systems.

In case the invention is applied to a boat, by lowering the platform 3 so as to reach the fully open position of the swing arms 32*a*, 32*b*, it is possible to immerse this platform 3 underneath the surface of the water, allowing hauling out and launching of a tender or similar type of marine vehicle equipping the boat, while the steps 35 allow access for persons swimming in the water. It is also possible to vary the position of the platform 3 so as to reach decks of varying heights, while the fact that this platform 3 and the steps 35 remain in any case horizontal allows easy access from and onto the boat. Moreover, the fact that the platform 3 remains horizontal also during its entire movement allows easy access also for persons who have problems walking as well as the loading of bulky objects.

Anyway, the invention is not limited to such kind of application but, as can be easily understood, it may be used in any technical field, when the transport of loads between different height levels is required, while keeping constant the attitude of the transported load.

The invention claimed is:

1. Movable platform assembly, comprising a base portion, configured to be fixed to a support structure, at least one pivotable arm hinged at one end with said base portion, about a first hinging axis, and at the other end with a loading platform, about a second hinging axis, said at least one pivotable arm being configured to be rotated by means of actuating means, which are designed to allow said platform to maintain a constant inclination with respect to said base portion during rotation of said at least one pivotable arm, wherein said actuating means comprise a first and a second rotary actuator mounted on said first and second hinging axis, respectively, the first rotary actuator comprising a first part fastened to the base portion and a second part (52) rotatable with respect to the first part and fastened to the pivotable arm, and the second rotary actuator comprising a first part fastened to the loading platform and a second part rotatable with respect to the first part and fastened to the pivotable arm, said actuating means also comprising control means configured to control in a co-ordinated manner rotation of said first and second rotary actuators, wherein said control means comprise a reference inclination sensor fixed to the base portion and configured to provide a reference inclination signal indicating the inclination of the base portion, an alignment inclination sensor fixed to the loading platform and configured to provide an alignment inclination signal indicating the inclination of the platform, and a control unit programmed to compare with each other the values of the reference inclination signal and the alignment inclination signal and perform rotation of said first and second rotary actuators depending on said comparison, and wherein said at least one pivotable arm is provided with a plurality of step elements which are mounted along a length of the at least one pivotable arm and are designed to allow easier access for persons to the loading platform; and alignment means which connect the first part of the first rotary actuator to a plurality of transmission members which are respectively fastened to said step elements and are rotatable about axes parallel to the first hinging axis so as to allow said plurality of step elements to maintain in a constant manner substantially the same inclination of said loading platform during rotation of said at least one pivotable arm.

2. Platform assembly according to claim 1, wherein said control means also comprise a movement inclination sensor fixed to the swing arm and configured to provide the control unit with a movement inclination signal indicating the inclination of the swing arm, said control unit being programmed to compare with each other the values of the reference inclination signal and the movement inclination signal, so as to be configured to determine an angle of rotation of the swing arm with respect to the base portion.

3. Platform assembly according to claim 1, wherein said at least one pivotable arm is formed as a pair of parallel pivotable arms and said first and second rotary actuators are formed as dual rotary actuators, the respective first parts of which are formed as end shafts which are respectively fixed to the base portion and to the loading platform.

4. Platform assembly according to Claim 1, wherein said transmission members are respectively formed as pulley elements, each fastened to the respective step element, said alignment means being configured as a chain which connects the pulley elements of the step elements to the first part of the first rotary actuator so that these pulley elements are configured to rotate in the same sense with respect to the pivotable arm.

5. Platform assembly according to claim 1, also comprising alignment means formed by a system of levers which connect together said step elements so as to allow said plurality of step elements to maintain in a substantially constant manner the same inclination of said platform during rotation of said at least one pivotable arm.

6. Platform assembly according to claim 1, wherein said support structure is a boat.

* * * * *